US006540444B2

(12) United States Patent
Fukushima

(10) Patent No.: US 6,540,444 B2
(45) Date of Patent: Apr. 1, 2003

(54) ROTATING PILE FOR UNDERGROUNDING

(75) Inventor: Masanori Fukushima, Koriyama (JP)

(73) Assignee: Fukushima Pulse Co., Ltd., Koriyama (JP)

( * ) Notice: Subject to any disclaimer, the term of this patent is extended or adjusted under 35 U.S.C. 154(b) by 0 days.

(21) Appl. No.: 10/055,124

(22) Filed: Jan. 22, 2002

(65) Prior Publication Data

US 2002/0098045 A1 Jul. 25, 2002

(30) Foreign Application Priority Data

Jan. 23, 2001 (JP) ..... 2001-014196

(51) Int. Cl.[7] ..... E02D 7/14
(52) U.S. Cl. ..... 405/253
(58) Field of Search ..... 405/231, 229, 405/249, 252.1, 253

(56) References Cited

U.S. PATENT DOCUMENTS 1,954,070 A * 4/1934 Cook ..... 405/253
2,151,847 A * 3/1939 Greulich ..... 405/253
2,168,269 A * 8/1939 Orr et al. ..... 405/253
3,688,014 A * 8/1972 Versteeg ..... 405/253
6,309,143 B1 * 10/2001 Merjan et al. ..... 405/253

FOREIGN PATENT DOCUMENTS

JP 10-121470 5/1998
JP 2893443 3/1999

* cited by examiner

*Primary Examiner*—Frederick L. Lagman
(74) *Attorney, Agent, or Firm*—Christensen O'Connor Johnsen Kindness PLLC

(57) ABSTRACT

The rotating pile for undergrounding contains a pile-head pipe having a longitudinal center line, a pipe wall, one end portion, and the other end portion opposite to the one end portion. Three or four recessed portions in which the pipe wall is recessed toward the center line are formed in the one end portion. Blades defined by the pipe wall are formed between the adjacent recessed portions. Each of the recessed portions is inclined from the circumferential surface of the pile-head pipe toward the center line. The pipe wall defining one of the adjacent recessed portions contact with the pipe wall defining the other recessed portion so as to cause the one end to be substantially closed. The blades extend radially outward from the center line. The blades gradually expand in the circumferential direction of the pile-head pipe from its top end toward its base end portion.

7 Claims, 7 Drawing Sheets

ROTATING PILE FOR UNDERGROUNDING

CROSS-REFERENCE TO RELATED APPLICATIONS

This application is based upon and claims the benefit of priority from the prior Japanese Patent Application No. 2001-014196, filed Jan. 23, 2001, the entire content of which is incorporated herein by reference.

BACKGROUND OF THE INVENTION

1. Field of the Invention

The present invention relates to a rotating pile for undergrounding with an improved supporting force.

2. Description of the Related Art

In constructing a building, a foundation work is performed in general in the construction process. Where the ground is weak, piles are driven into the ground in the foundation work before placing the concrete foundation.

Various kinds of piles are used for the foundation work. For example, a rotating pile for undergrounding is disclosed in Japanese Patent No. 2893443. The rotating pile for undergrounding disclosed in this Japanese Patent is constructed as shown in FIGS. 16 to 18. FIG. 16 is a perspective view showing the conventional rotating pile 1 for undergrounding. FIG. 17 is a plan view, as viewed from one end side, of the rotating pile 1 shown in FIG. 16. FIG. 18 shows the rotating pile 1 shown in FIG. 16, which is driven into the ground.

The rotating pile 1 includes a pile-head pipe 2 having a pipe wall 21, a longitudinal center line L, one end portion 22, and a pipe body 24. A spindle section 3 and two blades 4 are formed in the end portion 22. The two blades 4 are separated from each other at the longitudinal center line L. The spindle section 3 and the blades 4 are formed by crushing with a forming apparatus from both sides in a radial direction perpendicular to the longitudinal center line L. That is, the spindle section 3 and the blades 4 are formed by a press-forming (forging) with the forming apparatus.

The spindle section 3 is flared from the end portion 22 toward the pipe body 24 along the longitudinal center line 1.

Two blades 4 extend from the spindle portion 3 along the longitudinal center line L and most protrude in the direction of the center line L in the vicinity of the center line L. To be more specific, when viewed in a direction perpendicular to the longitudinal center line L, the tips of the two blades along the center line L are formed to be V-shaped. The two blades 4 are twisted by a predetermined angle $\alpha$ (see FIG. 17) in the rotating direction about the longitudinal center line L. The other end portion opposite to the one end portion 22 is connected to a pile-driving apparatus (not shown).

As shown in FIG. 18, the rotating pile 1 is driven by the pile-driving apparatus so as to be driven into the ground 5 such that the end portion 22 of the rotating pile 1 is driven first into the ground 5 while the rotating pile 1 is being rotated about the center line L. Since the rotating pile 1 is provided with the two blades 4, a hole 6 is formed in the ground while removing the soil 7. Therefore, the rotating pile 1 can be driven into the ground 5 in a short time. Also, the blades 4 are twisted as described above. Therefore, the soil 7 removed by the blades 4 moves from the circumferential direction of the pile-head pipe 2. Also, the spindle portion 3 is formed such that the contour of the spindle portion 3 is gradually increased from the end portion 22. As a result, the soil 7 moved in the circumferential direction is pressed against the inner wall of the hole 6 by the side walls of the spindle portion 3 and the pile-head pipe 2. What should also be noted is that, since the soil 7 is pressed against the inner wall of the hole 6, the soil 7 is scarcely discharged from within the hole 6 to the outside. It follows that the rotating pile 1 for undergrounding can be driven into the ground without requiring the troublesome disposal of the soil discharged to the outside.

As described above, the end portion 22 is formed by the press-forming so as to form integral the pipe body 24 and the blades 4. As a result, the rotating pile 1 can be manufactured at a low cost. Also, in the conventional rotating pile 1 shown in the drawing, the spindle portion 3 and the blades 4 can be formed after the pile-head pipe 2 is cut into a desired length.

In the conventional rotating pile 1 for undergrounding, the two blades 4 are formed simultaneously by crushing the end portion 22 from both sides in the radial direction as described previously. Also, the rotating pile 1 for undergrounding has a tip in the radial direction of the pile-head pipe. The tip has a distance from the longitudinal center line, which is about 1.4 times as much as the radius of the pile-head pipe 2. In other words, the blades 4 protrude greatly to the outside from the outer circumference of the pile-head pipe 2. As a result, the blades 4 protruding to the outside soften the soil 7 outside the outer circumference of the pile-head pipe 2 when the rotating pile 1 is driven into the ground. Incidentally, the supporting force of the pile of this type is equal in general to the resultant of forces between the bottom surface-supporting force proportional to the cross sectional area of the bottom of the pile and the frictional force between the side surface of the pile and the soil 7 in contact with the side surface of the pile. In the conventional rotating pile 1 for undergrounding, the surrounding soil 7 is softened over a wide range so as to lower the frictional force. Thus, in the conventional rotating pile 1, the entire supporting force is decreased. In other words, the supporting force of the rotating pile 1 is lowered after the rotating pile 1 is driven into the ground.

Where the rotating pile 1 is driven into the hard ground, those portions of the blades 4 which greatly protrude from the circumference of the pile-head pipe 2 may be bent. In this case, it is difficult to drive smoothly the rotating pile 1 for undergrounding into the ground.

Also, the blades 4 have a V-shaped tip like an auger along the center line L as described previously. If the tip of the blades 4 strikes against a hard material such as a stone, the axis of rotation of the blades 4 is deviated. Therefore, it is possible for the rotating pile 1 to fail to be driven vertically downward. Further, the blades 4 are twisted as described previously, with the result that the forging die for preparing the blades 4 is rendered complex in construction and expensive.

The present invention, which has been achieved in view of the situation described above, is intended to provide a rotating pile for undergrounding which can be manufactured easily and which has a high supporting force.

BRIEF SUMMARY OF THE INVENTION

A rotating pile for undergrounding according to a first aspect of the present invention comprises a pile-head pipe. The pile-head pipe has a longitudinal center line, a pipe wall, one end portion, and the other end portion on the opposite side of the one end portion. Three or four recessed portions in which the pipe wall is recessed toward the longitudinal center line are formed in the one end portion of the pile-head pipe. Also, the blades defined by the pipe wall are formed between the adjacent recessed portions. Naturally, the number of recessed portions is equal to the number of blades. Each of the recessed portions is inclined from the circumferential surface of the pile-head pipe toward the longitudinal center line. Each blade is defined between the adjacent recessed portions. The pipe wall defining one of the adjacent recessed portions contacts with the pipe wall defining the other recessed portion. The one end of the pile-head pipe is thereby substantially closed. Also, the blades extend radially outward from the longitudinal center line. Further, the blades gradually expand in the circumferential direction of the pile-head pipe from its top end of toward the base end portion.

According to a second aspect of the present invention, there is provided a rotating pile for undergrounding, comprising a pile-head pipe and a pile-head-supporting pipe. The pile-head pipe includes a longitudinal center line, a pipe wall, one end portion, and the other end portion opposite to the one end portion referred to above. Three or four recessed portions in which the pipe wall is recessed toward the longitudinal center line are formed in the one end portion noted above. Also, in the one end portion, the blades defined by the pipe wall are formed between the adjacent recessed portions. Naturally, the number of recessed portions is equal to the number of blades. Joining-portions expanded in a flared fashion are formed in the other end portion of pile-head pipe. Each of the recessed portions is inclined from the circumferential surface of the pile-head pipe toward the longitudinal center line. Each blade is defined between the adjacent recessed portions. The pipe wall defining one of the adjacent recessed portions contact with the pipe wall defining the other recessed portion so as to cause the one end of the pile-head pipe to be substantially closed. Also, the blades extend radially outward from the longitudinal center line. Further, the blades gradually expand in the circumferential direction of the pile-head pipe from its top end of toward the base end portion. The pile-head-supporting pipe is joined to the pile-head pipe in the joining-portion.

Additional objects and advantages of the present invention will be set forth in the description which follows, and in part will be obvious from the description, or may be learned by practice of the present invention. The objects and advantages of the present invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the present invention, and together with the general description given above and the detailed description of the embodiments given below, serve to explain the principles of the present invention.

DETAILED DESCRIPTION OF THE INVENTION (First Embodiment)

Figure 1:
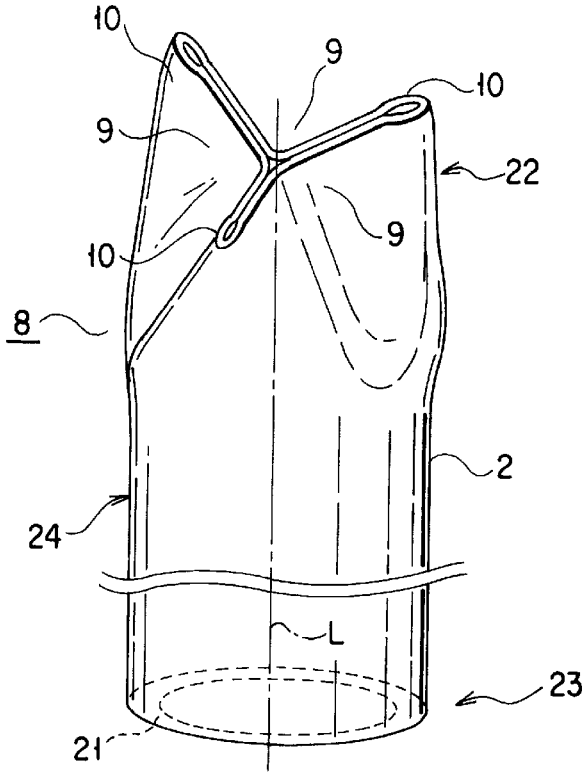
FIG. 1 is a perspective view showing a rotating pile for undergrounding according to a first embodiment of the present invention.

A rotating pile for undergrounding according to a first embodiment of the present invention will now be described with reference to FIGS. 1 to 8. FIG. 1 is a perspective view showing a rotating pile 8 for undergrounding according to the first embodiment of the present invention.

As shown in the drawing, the rotating pile 8 for undergrounding comprises a pile-head pipe 2. The pile-head pipe 2 is formed of a material having a desired rigidity, e.g., steel. The pile-head pipe 2 includes a longitudinal center line L, a pipe wall 21, one end portion 22, the other end portion 23, and a pipe body 24. The pile-head pipe 2 is cylindrical. The one end portion 22 forms the edge portion on the side of the distal end (tip) of the pile-head pipe 2 and the other end portion 23 forms the edge portion on the side of the rear end of the pile-head pipe 2. In other words, the other end portion 23 forms the edge portion on the side opposite to the end portion 22. The pipe body 24 forms the intermediate portion of the pile-head pipe 2 between the end portion 22 and the other end portion 23. The pipe wall 21 is set at a predetermined thickness. The end portion 22 includes three recessed portions 9 and blades 10. The number of blades 10 is equal to the number of recessed portions 9.

Figure 2:
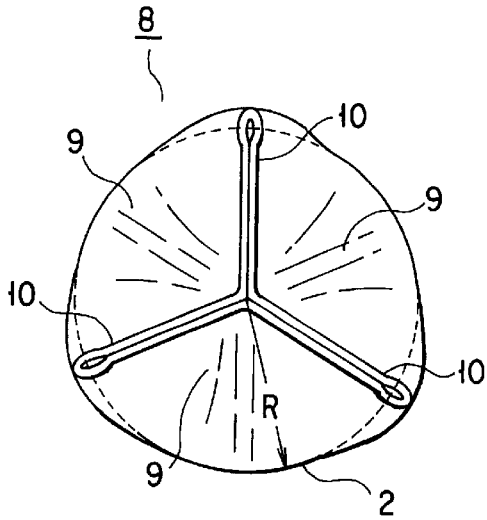
FIG. 2 is a plan view showing the rotating pile for undergrounding shown in FIG. 1.
Figure 4:
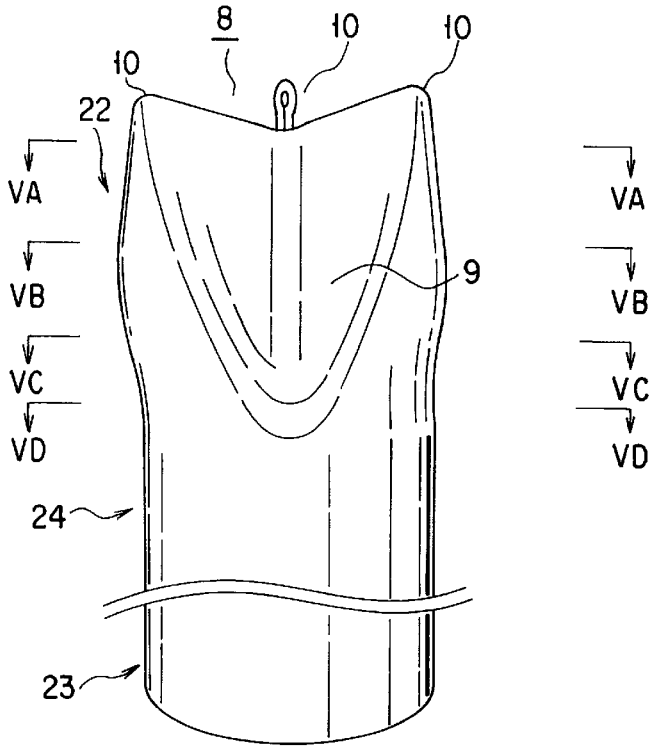
FIG. 4 is a front view showing the rotating pile for undergrounding shown in FIG. 1.
Figure 5A:
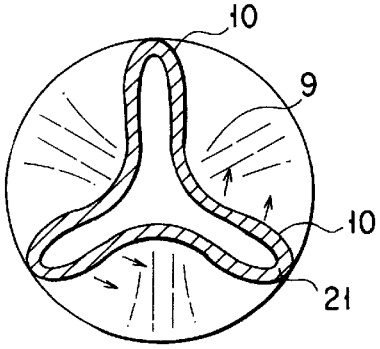
FIG. 5A is a cross sectional view showing the rotating pile for undergrounding along the line VA—VA shown in FIG. 4.
Figure 5B:
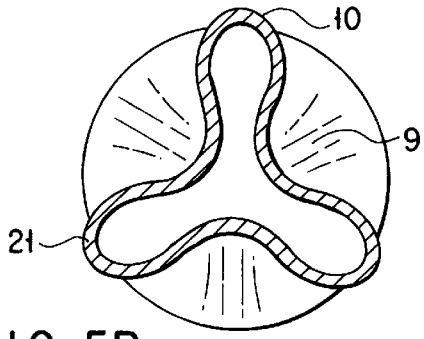
FIG. 5B is a cross sectional view showing the rotating pile for undergrounding along the line VB—VB shown in FIG. 4.
Figure 5C:
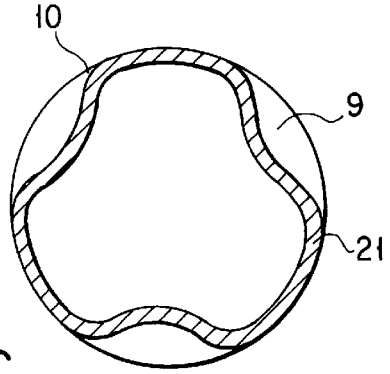
FIG. 5C is a cross sectional view showing the rotating pile for undergrounding along the line VC–VC shown in FIG. 4.
Figure 5D:
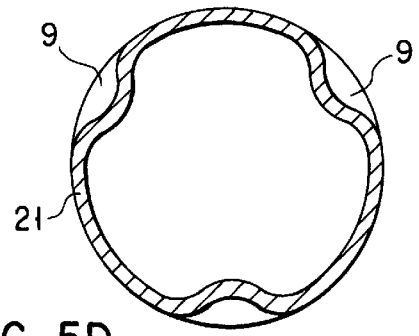
FIG. 5D is a cross sectional view showing the rotating pile for undergrounding along the line VD—VD shown in FIG. 4.

The three recessed portions 9 extend radially from the center of the pile-head pipe 2 so as to define the blades 10, as shown in FIG. 2. Each recessed portion 9 is formed such that the distal end of the pipe wall 21 is recessed in the end portion 22 toward the longitudinal center line in the radial direction of the pile-head pipe 2. To be more specific, the three recessed portions 9 are formed such that the tip of the pipe wall 21 is recessed from the three positions deviant from each other by 120° toward the center of the pile-head pipe 2. In other words, the pile-head pipe 2 is pushed such that the three portions of the pipe wall 21 at the distal end are collected in the Hi center of the pile-head pipe 2. As a result, each recessed portion 9 is formed such that the size in a direction perpendicular to the center line L is diminished away from the tip in the direction of the center line L. To be more specific, each recessed portion 9 extends from the tip to permit the contour of the recessed portion 9 to be substantially U-shaped as shown in FIG. 4.

Figure 3:
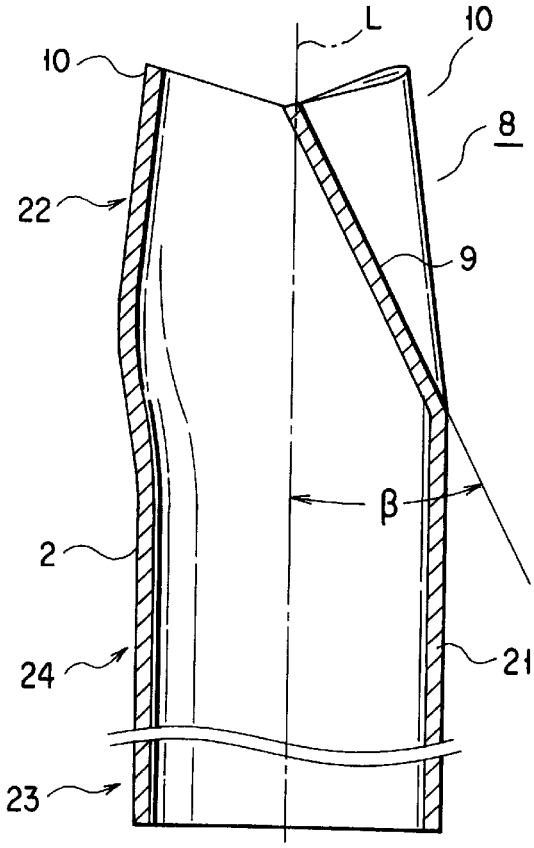
FIG. 3 is a vertical cross sectional view showing the rotating pile for undergrounding shown in FIG. 1.

As shown in FIG. 3, each recessed portion 9 is inclined from the circumferential surface of the pile-head pipe 2 toward the longitudinal center line in a manner to have a predetermined angle β relative to the center line L. In other words, each recessed portion 9 is formed so as to be inclined from the tip to reach the pipe body 24. The angle β noted above is set to fall within a range of between about 30° and 60°.

The blade 10 is formed of the pipe wall 21 positioned between the adjacent recessed portions 9. As a result, the number of blades 10 is equal to the number of recessed portions 9. Since the blade 10 is defined between the adjacent recessed portions 9, the blades 10 extend in the radial direction from the center of the pile-head pipe 2. The shape of the blade 10 will now be described more in detail with reference to FIG. 4 and FIGS. 5A to 5D. FIG. 4 is a front view showing the rotating pile for undergrounding shown in FIG. 1. On the other hand, FIGS. 5A to 5D are cross sectional views showing the horizontal cross sections differing from each other in the height position in respect of the rotating pile for undergrounding shown in FIG. 4. As apparent from FIGS. 5A to 5D, the recessed portion 9 is gradually diminished with increase in the distance from the tip. Therefore, the blade 10 is gradually expanded in the circumferential direction of the pile-head pipe 2 from the side of the tip of the pile-head pipe 2 toward the side of the rear end. As shown in FIG. 1, the tip of the blade 10 is substantially closed. In other words, the pipe wall 21 defining one of the adjacent recessed portions 9 contact with the pipe wall 21 of the other recessed portion 9 so as to form the tip of the blade 10. The blade 10 is gradually expanded in the circumferential direction from the contact position noted above toward the side in the rear end.

Incidentally, in the pipe wall 21 in the tip portion, the three portions are collected in the center of the pile-head pipe 2 as described previously. As a result, the blade 10 is formed such that the periphery in the vicinity of the center line L is formed closer to the axial direction of the pile-head pipe 2, compared with the tip portion on the side of the outer circumference of the pile-head pipe 2. In other words, the blade 10 is formed such that the distal end along the center line L is arranged on the side of the outer circumference. A maximum distance in the radial direction of the blade 10 is set at a predetermined value. As utilized herein, the term "maximum distance in the radial direction" is utilized to refer to the distance between the longitudinal center line and the remotest portion of the blade 10 from the longitudinal center line, in the radial direction of the pile-head pipe 2. The maximum distance in the radial direction is defined to fall within a range of between about 1.1 and 0.7 times as much as the radius of the pile-head pipe 2.

Figure 6A:
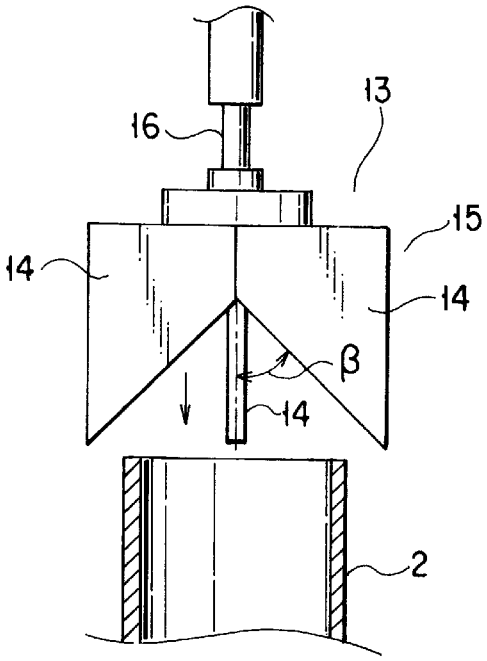
FIG. 6A shows the state before the rotating pile for undergrounding is pushed by a forming apparatus.

A forming apparatus 13 shown in, for example, FIG. 6A is used for manufacturing the rotating pile 8 for undergrounding. The forming apparatus 13 comprises a forging die 15 and a cylinder 16 for driving the forging die 15. As shown in FIG. 6A, the forging die 15 is mounted to the tip of the cylinder 16. The forging die 15 includes three pushing boards 14 each formed in a triangular shape. The edge portions of these three pushing boards are joined to each other such that these pushing boards 14 are allowed to extend in a radial direction 120° apart from each other. Also, these three pushing boards 14 are arranged such that the inclined planes face the center side of the cylinder 16 and the driving direction of the cylinder. Incidentally, the angle of inclination of the three pushing boards 14 is set equal to the angle β relative to the axis of the cylinder 16. Also, the pushing board 14 is formed in the shape of a thin plate. However the pushing board 14 has a sufficiently high mechanical strength so as to prevent the pushing board 14 from being bent when the pushing board 14 is pushed against the pile-head pipe 2.

Figure 6B:
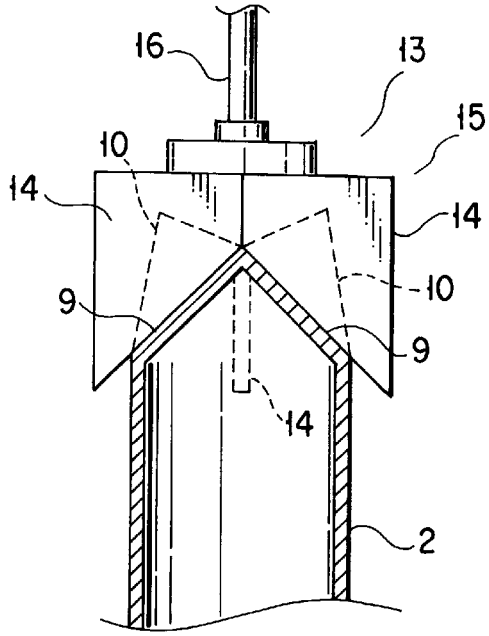
FIG. 6B shows the state that the rotating pile for undergrounding is being pushed by a forming apparatus.

For manufacturing the rotating pile 8 for undergrounding, the pile-head pipe 2 is arranged first in a position apart from the forming apparatus 13 in the driving direction of the cylinder 16. Then, the longitudinal center line L of the pile-head pipe 2 is aligned with the central axis of the cylinder 16. Subsequently the cylinder 16 is droved toward the end 22 (distal end) of the pile-head pipe 2. As a result, the pipe wall 21 of the end portion 22 is gradually crushed by the three pushing boards 14, as shown in FIG. 6B. The pushing boards 14, which expand radially 120° apart from each other, have the inclined surfaces. As a result, three portions of the pipe wall 21 in the end portion 22 are pushed toward the center. In other words, the pipe wall 21 is pushed in three directions so as to form the recessed portion 9 in the portion pushed by the pushing board 14. At the same time, the three blades 10 are formed to extend in the radial direction between the adjacent recessed portions 9.

As described above, the angle of inclination of the pushing board 14 is set equal to the angle β of the inclination referred to previously, with the result that the recessed portion 9 is formed to have the angle β of inclination referred to above. Also, the pushing board 14, which is inclined, is formed thin. As a result, the formed blade 10 is shaped such that the distal end side is closed and the formed blade 10 is gradually swollen toward the rear side as described previously. Incidentally, the thickness of the pushing board 14 is not particularly limited as far as it is possible to form the blade 10 in a desired shape.

In the case of forging as described above, it is possible to manufacture the rotating pile 8 for undergrounding by the pushing alone with the pushing board 14. Since the twisting is not employed as in the prior art, it is unnecessary to employ a forging die of a complex shape for forming the blade 10. As described above, the rotating pile 8 for undergrounding can be easily formed by forging die 15 which is combined with the pushing boards 14 and which is mounted on the ordinary press apparatus.

Figure 7:
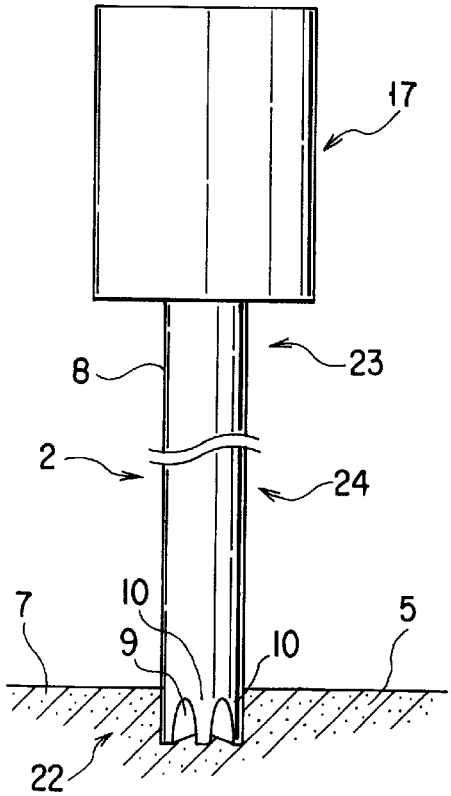
FIG. 7 is a side view showing the rotating pile for undergrounding, which is mounted to a driving apparatus.
Figure 8:
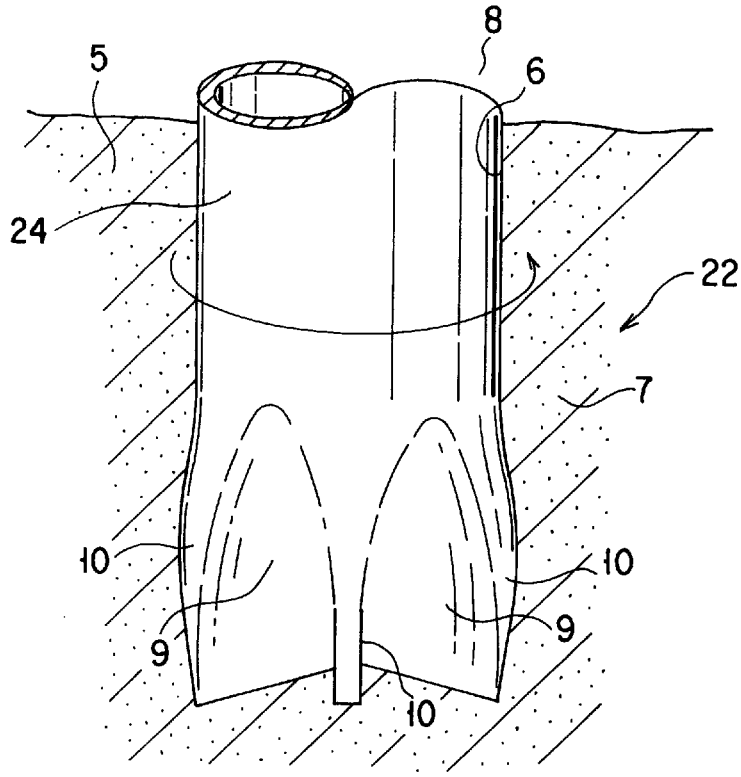
FIG. 8 is a side view showing in a magnified fashion the rotating pile for undergrounding, which is being driven into the ground.

The method of driving the rotating pile 8 for undergrounding according to the first embodiment of the present invention will now be described with reference to FIGS. 7 and 8. FIG. 7 is a side view showing the rotating pile 8 for undergrounding mounted to a driving apparatus 17, and FIG. 8 is a side view showing in a magnified fashion the rotating pile for undergrounding, which is driven into the ground. The driving apparatus 17, which rotatably supports the rotating pile 8, is capable of driving the rotating pile 8 into the ground while rotating the rotating pile 8. In order to rotate the rotating pile 8, the driving apparatus 17 is provided with a motor. The driving apparatus 17 is capable of being constructed to be capable of standing by itself and is also capable of being supported by a construction equipment. Incidentally, when mounted to a construction equipment, it is possible to connect the driving apparatus 17 to the power source of the construction equipment such as the hydraulic driving section and the power supply section so as to drive the motor mounted in the driving apparatus.

In order to drive the rotating pile 8 for undergrounding into the ground, the rotating pile 8 is arranged first such that the tip (distal end) of the rotating pile faces the ground and, then, mounted to the driving apparatus 17 such that the center line L is held vertical. That is, the other end portion 23 of the rotating pile 8 is fixed to the driving apparatus 17. Then, the end portion 22 is allowed to face the ground, followed by driving the motor so as to drive the rotating pile 8 into the ground 5. The three blades 10 are equidistantly arranged in a projecting fashion in the tip of the rotating pile 8 for undergrounding. Therefore, the blades 10 form the hole 6 while removing the soil 7. As shown in FIG. 8, the central portion in which the three blades 10 are collected is recessed in the direction along the center line L, compared with the tip portion on the side of the outer circumferences of the blades 10. Also, the three portions at the tips of the blades 10 in the direction along the center line L proceed into the ground 5 prior to the other portions of the blades 10 while being rotated on the same circumference of a circle. Therefore, the rotating pile 8 proceeds within the ground 5 under the state that the soil around the center of rotation of the blade 10 is softened. It follows that, even if the rotating pile 8 for undergrounding strikes against, for example, a stone, the center of rotation of the blade 10 is prevented from being deviated unlike the conventional rotating pile for undergrounding having a sharp tip like an auger. It follows that it is possible for the rotating pile 8 for undergrounding to be kept driven in the vertical direction.

Figure 18:
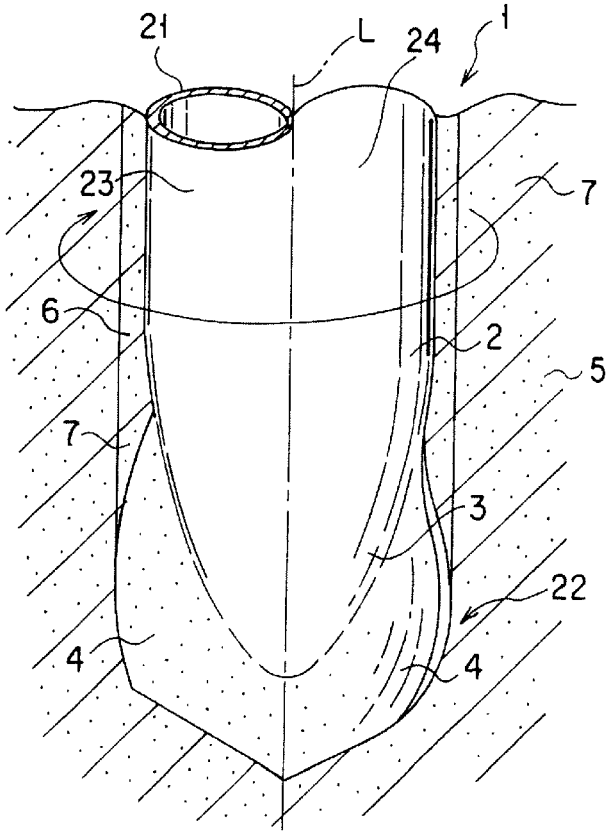
FIG. 18 (PRIOR ART)
FIG. 18 shows the state that the rotating pile for undergrounding shown in FIG. 16 is driven into the ground.

It should also be noted that the blade 10 is shaped to be swollen in the circumferential direction from the tip portion toward the rear end as described previously. Therefore, the removed soil 7 is guided in the circumferential outer direction by the blade 10 and the recessed portion 9, and the guided soil is pressed between the circumferential surface of the pipe body 24 and the inner circumferential surface of the hole 6. As a result, the soil 7 fastens the inner circumferential surface of the hole 6 and the ground around the hole 6. Incidentally, the maximum distance in the radial direction of the blade 10 is set to fall within a range of between 1.1 and 0.7 as much as the radius R of the pile-head pipe 2. As a result, the blade 10 does not greatly protrude outward from the outer circumference of the pile-head pipe 2 unlike the conventional rotating pile for undergrounding shown in FIG. 18. Therefore, the blade 10 does not soften the surrounding soil 7 over a wide range. That is, the rotating pile 8 can be driven into the ground 5 with without softening the surrounding soil 7. The rotating pile 8 for undergrounding driven into the ground permits markedly increasing the frictional force with the surrounding ground, compared with the conventional rotating pile for undergrounding.

It should be noted that, if the maximum distance in the radial direction exceeds 1.1 times as much as the radius R of the pile-head pipe 2, the surrounding soil is softened over a wide range. Thereby, the frictional force between the rotating pile, which is driven into the ground, and the surrounding ground is diminished. Also, where the ground is hard, the blade 10 is likely to be bent. On the other hand, if the maximum distance in the radial direction is smaller than 0.7 times as much as the radius R of the pile-head pipe 2, the width of the blade 10 is decreased. Thereby, the removing efficiency of the soil 7 performed by the blade 10 is rendered poor.

Incidentally, the angle β of inclination of the recessed portion 9 is set to fall within a range of between about 30° and 60°, as shown in FIG. 3. The angle β of inclination determines the length of the blade 10 and the depth of the recessed portion 9. Therefore, the removing function of the soil 7 and the smooth guiding function of the soil are effected by the angle β of inclination. Where the angle β of inclination relative to the center line L is less than 30°, the blade 10 is rendered excessively long, resulting in failure to guide the soil 7 smoothly. As a result, the soil 7 is plugged in the recessed portion 9 so as to tend to be rotated together with the rotating pile 8 for undergrounding. On the other hand, if the angle β of inclination exceeds 60°, the blade 10 is rendered excessively short so as to lower the function of removing the soil 7. As a result, the penetrating speed of the rotating pile 8 for undergrounding is lowered. It follows that it is desirable for the angle β of inclination to fall within a range of about 30° and 60°.

Figure 9A:
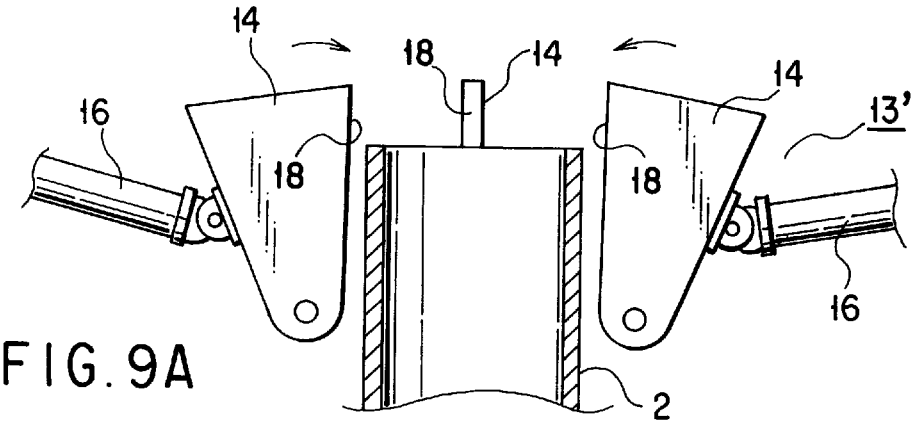
FIG. 9A shows the state before the rotating pile for undergrounding is pushed by another forming apparatus.
Figure 9B:
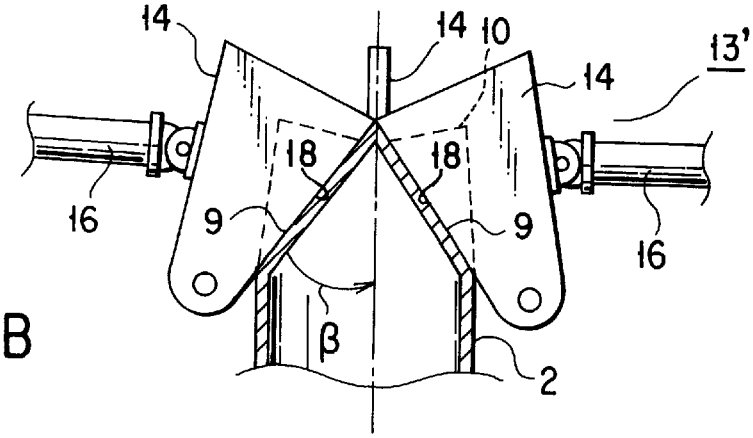
FIG. 9B shows the state that the rotating pile for undergrounding is being pushed by another forming apparatus.

Another forming apparatus capable of manufacturing the rotating pile 8 for undergrounding according to the first embodiment of the present invention will now be described with reference to FIGS. 9A and 9B. FIG. 9A shows another forming apparatus 13'. As shown in the drawing, the forming apparatus 13' comprises three cylinders 16 and three pushing boards 14 joined to the cylinders 16, respectively. These pushing boards 14 are separated from each other. However, as shown in FIG. 9A, the pushing boards 14 of the forming apparatus 13' are radially arranged 120° apart from each other like the pushing boards 14 included in the forming apparatus 13 described previously. Therefore, each pushing board 14 included in the forming apparatus 13' is held by each cylinder 16. Incidentally, each pushing board 14 is rotated by the cylinder 16. It should be noted that each pushing board 14 is shaped substantially triangular. Also, each pushing board 14 has a pushing plane 19 for pushing the pile-head pipe 2. The three pushing boards 14 are rotated by the cylinders 16 such that the edge portions on one side of the pushing planes 19 are collected in the vicinity of the center of the radial arrangement of the pushing boards 14. The pushing plane 19 is set to permit the angle of inclination relative to the vertical plane to be equal to the angle β of inclination of the recessed portion 9 referred to above when the edge portions on one side are collected as described above.

The pile-head pipe 2 is arranged in the forming apparatus 13' before the driving as shown in FIG. 9A. The pile-head pipe 2 is arranged vertical such that the center line L passes through the center of the radial arrangement of pushing boards 14. Then, the forming apparatus 13' permits the cylinder 16 to be elongated so as to rotate the pushing board 14. As a result, the pipe wall on the side of the tip of the pile-head pipe 2 is crushed so as to form the recessed portion 9, as shown in FIG. 9B.

Figure 10:
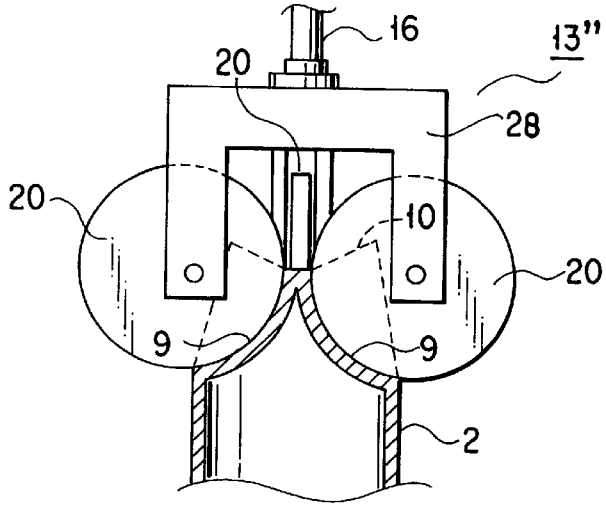
FIG. 10 shows the state that the rotating pile for undergrounding is being pushed by another forming apparatus.

Another forming apparatus 13" capable of manufacturing the rotating pile 8 for undergrounding according to the first embodiment of the present invention will now be described with reference to FIG. 10. Specifically, the forming apparatus 13" shown in FIG. 10 comprises three discs 20, supporting frames 28 for supporting the discs 20, and a cylinder 16. The three discs 20 are arranged radially 120° apart from each other like the pushing boards 14 included in the forming apparatus 13 described previously. These discs 20 are rotatably supported by the supporting frames 28. On the other hand, the cylinder 16, which is constructed like the cylinder included in the forming apparatus 13, serves to support the supporting frame 28.

The pile-head pipe 2 is arranged in the forming apparatus 13" as in the forming apparatus 13 described previously. The cylinder 16 included in the forming apparatus 13" is driven. As a result, the supporting frame 28 is driven so as to permit the disc 20 to be pushed against the pile-head pipe 2. The discs 20, which are rotated, successively crush the tip of the pile-head pipe 2 in three directions so as to form the recessed portions 9 in a bent and inclined state.

(Second Embodiment)

Figure 11:
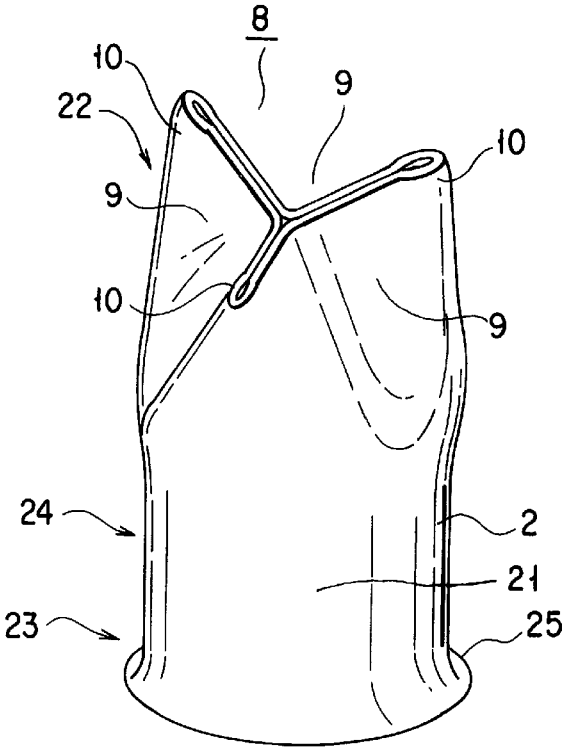
FIG. 11 is a perspective view showing a rotating pile for undergrounding according to a second embodiment of the present invention.

The rotating pile 8 for undergrounding according to a second embodiment of the present invention will now be described with reference to FIG. 11. Specifically, FIG. 11 is a perspective view showing the rotating pile 8 for undergrounding according to the second embodiment of the present invention.

The pile-head pipe 2 included in the rotating pile 8 for undergrounding according to the second embodiment of the present invention is formed shorter than the pile-head pipe 2 included in the rotating pile 8 according to the first embodiment of the present invention. The end portion 22 is also provided in the pile-head pipe 2 in this embodiment, as in the first embodiment. In the second embodiment of the present invention, however, the other end portion 23 of the pile-head pipe 2 has a joining-portion 25. In the joining-portion 25, the pipe wall 21 flares. Also, the rotating pile 8 for undergrounding according to the second embodiment of the present invention includes a pile-head-supporting pipe 2*a* formed as a separate member. The pile-head-supporting pipe 2*a* is a linear pipe.

The joining-portion 25 can be formed simultane-ously with formation of the blade 10, if the forging die is applied by using the forming apparatus 13 shown in FIG. 6A, with the lower forging die put inside the other end portion of the pile-head pipe 2.

Figure 12:
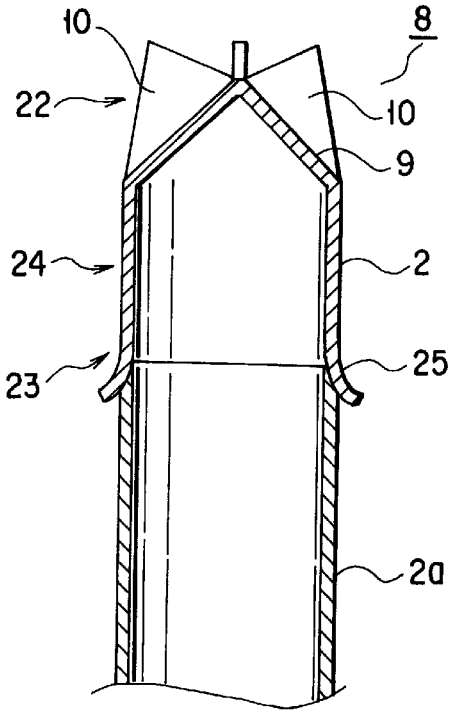
FIG. 12 is a cross sectional view showing a rotating pile for undergrounding prepared by joining the head formed as shown in FIG. 11 to the tip of a linear pipe.

The rotating pile 8 for undergrounding can be prepared by joining the pile-head pipe 2 and the pile-head-supporting pipe 2*a*, which are manufactured separately. Specifically, the tip portion of the pile-head-supporting pipe 2*a* is inserted inside the flared joining-portion 25 of the pile-head pipe 2 and welded together as shown in FIG. 12 so as to prepare the rotating pile 8 for undergrounding.

In the rotating pile 8 for undergrounding according to the second embodiment of the present invention, the pile-head pipe 2 is manufactured separately from the pile-head-supporting pipe 2*a* and, thus, operation of the press-forming can be performed easily. It is also possible to transport the pile-head pipe 2 and the pile-head-supporting pipe 2*a* to the worksite under the state before the joining and to perform the joining on the worksite.

The rotating pile 8 for undergrounding according to the second embodiment of the present invention can be subjected easily to the press-forming and has a large frictional force. Also, the cross sectional area of the rotating pile 8 for undergrounding is increased in the flared joining-portion 25 so as to increase the bottom supporting force. It follows that it is possible to increase markedly the bottom supporting force by slightly increasing the cross sectional area of the rotating pile 8 for undergrounding in the flared joining-portion 25.

(Third Embodiment)

Figure 13:
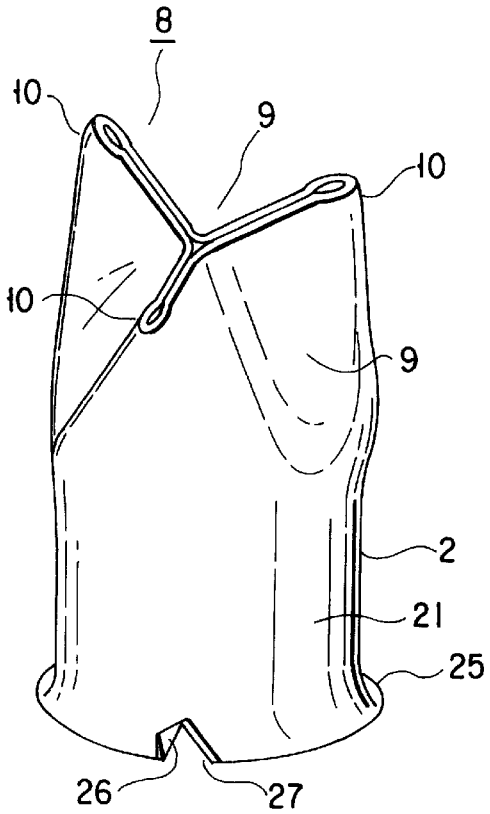
FIG. 13 is a perspective view showing a rotating pile for undergrounding according to a third embodiment of the present invention.
Figure 14:
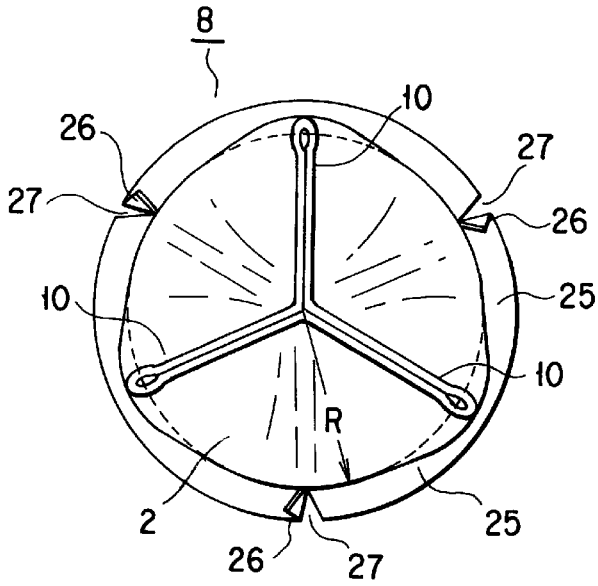
FIG. 14 is a plan view showing the rotating pile for undergrounding shown in FIG. 13.

A rotating pile 8 for undergrounding according to a third embodiment of the present invention will now be described with reference to FIGS. 13 and 14. FIG. 13 is a perspective view showing the rotating pile 8 for undergrounding according to the third embodiment of the present invention, and FIG. 14 is a plan view of the pile-head pipe 2 included in the rotating pile 8 shown in FIG. 13.

The rotating pile 8 for undergrounding according to the third embodiment of the present invention is substantially equal to that according to the second embodiment described above, except that, in the third embodiment, the joining-portion 25 of flared-shape includes a propelling blade 26 and a V-shaped slit 27.

In the third embodiment of the present invention, cuttings are equidistantly formed in three points in the flared joining-portion 25 of the pipe wall 21. The propelling blade 26 and the V-shaped slit 27 are formed by folding the pipe wall 21 toward to tip of the pile-head pipe 2.

In the rotating pile 8 for undergrounding according to the third embodiment of the present invention, the propelling blades 26 are equidistantly formed in the joining-portion 25, with the result that the propelling blades 26 inclined downward (in the driving direction) are allowed to bite the soil in accordance with rotation of the rotating pile 8 for undergrounding. Also, the soil 7 removed by the blades 26 is smoothly transferred through the V-shaped slits 27 toward the upper side (opposite to the driving direction of the rotating pile 8). It follows that the rotating pile 8 for undergrounding can be driven efficiently into the ground. As a result, the rotating pile 8 for undergrounding can be driven smoothly into the ground, and the bottom supporting force can be markedly increased, even if the joining-portion 25 is formed in a somewhat large flared shape.

(Fourth Embodiment)

Figure 15:
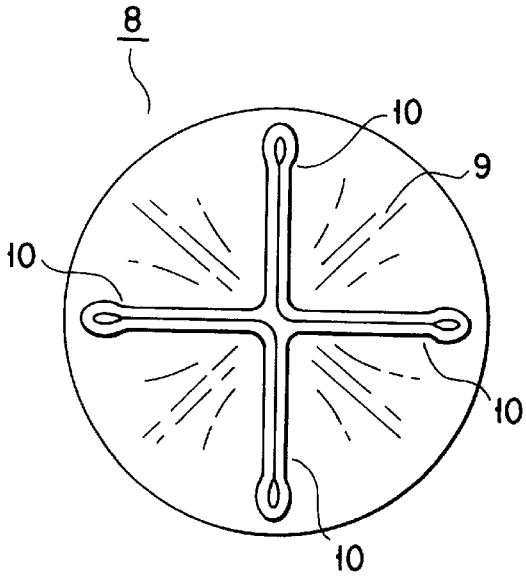
FIG. 15 is a plan view showing a rotating pile for undergrounding provided with four blades according to a fourth embodiment of the present invention.
Figure 16:
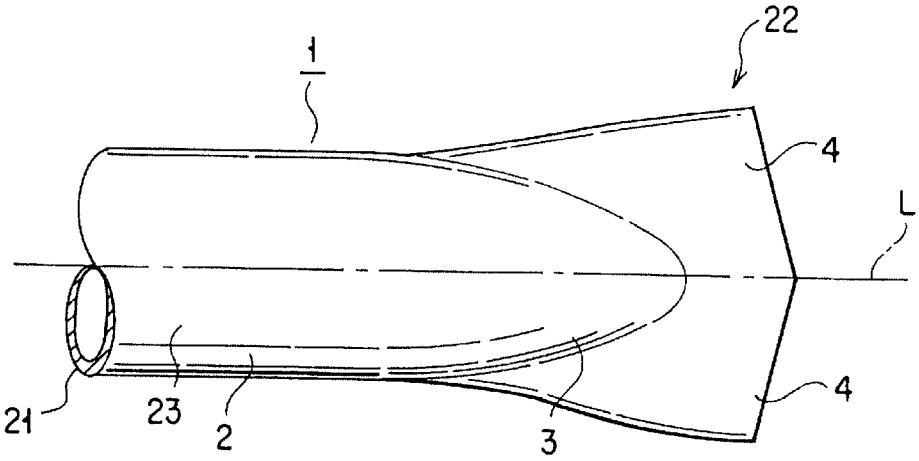
FIG. 16 (PRIOR ART)
FIG. 16 is a front view showing the conventional rotating pile for undergrounding.
Figure 17:
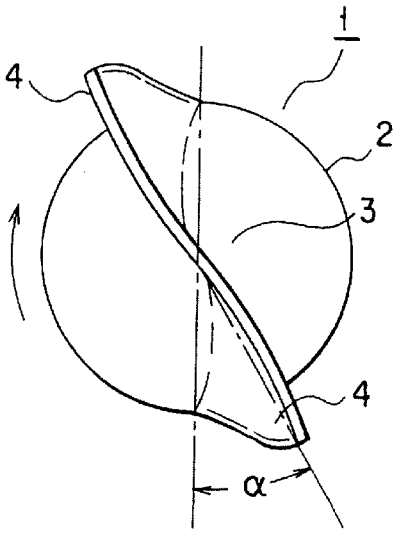
FIG. 17 (PRIOR ART)
FIG. 17 is a plan view showing the rotating pile for undergrounding shown in FIG. 16.

A rotating pile 8 for undergrounding according to a fourth embodiment of the present invention will now be described with reference to FIG. 15. Specifically, FIG. 15 is a plan view showing the rotating pile 8 for undergrounding according to the fourth embodiment of the present invention.

The rotating pile 8 according to the fourth embodiment is substantially equal to the rotating pile 8 according to the first embodiment, except that, the rotating pile 8 includes four recessed portions 9 and four blades 10. In the rotating pile 8 for undergrounding according to the fourth embodiment of the present invention, the recessed portions 9 are recessed 90° apart from each other. Also, the blades 10 extend radially from the center of the pile-head pipe 2 at an interval of 90°. If five or more blades 10 are formed in the rotating pile 8 for undergrounding, the width of the blade 10 is decreased, with the result that the soil 7 is accumulated to plug the recessed portion 9 so as to cause the soil 7 to be rotated together with the recessed portion 9. It follows that the rotating pile for undergrounding provided with five or more blades 10 is rendered low in the function of removing the soil 7. Such being the situation, it is desirable for the rotating pile for undergrounding to be provided with three or four blades 10 as in the first to fourth embodiments described above.

In each of the embodiments described above, the blade 10 is formed by applying a press-forming to one edge portion of the rotating pile for undergrounding. Alternatively, it is also possible to form the blade 10 by, for example, the casting, forging, or skiving from a solid material.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotating pile for undergrounding, comprising:

a pile-head pipe including a longitudinal center line, a pipe wall, one end portion having a tip end, and the other end portion opposed to the one end portion, the one end portion provided with three or four recessed portions formed in the pipe wall, wherein each recessed portion extends along the longitudinal center line, is recessed toward the longitudinal center line, and is inclined inward toward the longitudinal center line as the recessed portion approaches the tip end to substantially close the one end portion, the one end portion being further provided with blades formed of the pipe wall between the adjacent recessed portions, the number of blades being equal to the number of recessed portions, each blade projecting radially outward from the longitudinal center line, wherein a size of each blade gradually expands in a circumferential direction as each blade extends from the tip end toward the other end portion, and wherein a radially outward most region of each blade projects further in a direction along the longitudinal center line than a region of each blade located in the vicinity of the longitudinal center line.

2. The rotating pile for undergrounding according to claim 1, wherein a distance separating a point of each blade from the longitudinal center line falls within a range of between about 1.1 and 0.7 times as much as the radius of the pile-head pipe, wherein the point represents the furthest extent of each blade outward in a radial direction from the longitudinal center line.

3. The rotating pile for undergrounding according to claim 1, wherein an inclined angle of the recessed portion relative to the longitudinal center line falls within a range of between about 30° and 60°.

4. A rotating pile for undergrounding, comprising:

a pile-head supporting pipe;

a pile-head pipe including a longitudinal center line, a pipe wall, one end portion having a tip end, and the other end portion opposed to the one end portion, the one end portion provided with three or four recessed portions formed in the pipe wall, wherein each recessed portion extends along the longitudinal center line, is recessed toward the longitudinal center line, and is inclined inward toward the longitudinal center line as the recessed portion approaches the tip end to substantially close the one end portion, the one end portion being further provided with blades formed of the pipe wall between the adjacent recessed portions, the number of blades being equal to the number of recessed portions, each blade projecting radial outward from the longitudinal center line, wherein a size of each blade gradually expands in a circumferential direction as each blade extends from the tip end toward the other end portion, and wherein a radially outward most region of each blade projects further in a direction along the longitudinal center line than a region of each blade located in the vicinity of the longitudinal center line, and the other end portion having a joining portion joined to the pile-head supporting pipe.

5. The rotating pile for undergrounding according to claim 4, wherein a distance separating a point of each blade from the longitudinal center line falls within a range of between about 1.1 and 0.7 times as much as the radius of the pile-head pipe, wherein the point represents the furthest extent of each blade outward in a radial direction from the longitudinal center line.

6. The rotating pile for undergrounding according to claim 4, wherein an inclined angle of the recessed portion relative to the longitudinal center line falls within a range of between about 30° and 60°.

7. The rotating pile for undergrounding according to claim 4, wherein the joining portion is provided with a plurality of propelling blades which move soil, cut by the blades of the pile-head pipe, away from the pile-head pipe along the pile-head supporting pipe.

* * * * *

UNITED STATES PATENT AND TRADEMARK OFFICE

CERTIFICATE OF CORRECTION

PATENT NO. : 6,540,444 B2
DATED : April 1, 2003
INVENTOR(S) : M. Fukushima

It is certified that error appears in the above-identified patent and that said Letters Patent is hereby corrected as shown below:

Title page,
Item [74], *Attorney, Agent or Firm*, "Johnsen" should read -- Johnson --
Item [57], ABSTRACT,
Line 10, "portions contact" should read -- portions contacts --

Column 10,
Line 67, "one end portion," should read -- one end portion; --

Column 11,
Line 7, "one end portion," should read -- one end portion; and --
Line 35, "one end portion," should read -- one end portion; --

Column 12,
Line 5, "one end portion," should read -- one end portion; --
Line 10, "radial" should read -- radially --
Line 18, "line, and" should read -- line; and --

Signed and Sealed this

Eighth Day of July, 2003

JAMES E. ROGAN
*Director of the United States Patent and Trademark Office*